United States Patent [19]

Liljebrand et al.

[11] Patent Number: 4,805,705

[45] Date of Patent: Feb. 21, 1989

[54] DRILL BIT

[75] Inventors: Sven P. Liljebrand, Sandviken; Bernt S. Liljekvist, Storvik, both of Sweden

[73] Assignee: Santrade Limited, Lucerne, Switzerland

[21] Appl. No.: 96,266

[22] Filed: Sep. 8, 1987

Related U.S. Application Data

[63] Continuation of Ser. No. 847,708, Apr. 3, 1986, abandoned.

[30] Foreign Application Priority Data

Apr. 4, 1985 [SE] Sweden ..... 8501698

[51] Int. Cl.[4] ..... E21B 4/14

[52] U.S. Cl. ..... 173/80; 173/132; 175/418; 408/59

[58] Field of Search ..... 408/59; 173/80, 126, 173/132; 175/410, 415, 417, 418

[56] References Cited

U.S. PATENT DOCUMENTS

| | | | |
|---|---|---|---|
| 1,157,605 | 10/1915 | Waugh | 173/80 X |
| 1,232,111 | 7/1917 | Smith | 173/80 |
| 3,866,746 | 2/1975 | Curington | 173/80 X |
| 3,893,521 | 7/1975 | Bailey et al. | 173/80 |
| 4,003,442 | 1/1977 | Bassinger | 173/80 X |
| 4,094,364 | 6/1978 | Lundstrom et al. | 173/80 |
| 4,137,002 | 1/1979 | Barker et al. | 408/59 |
| 4,280,570 | 7/1981 | Walter | 173/80 X |
| 4,446,929 | 5/1984 | Pillow | 173/80 X |
| 4,450,920 | 5/1984 | Krasnoff et al. | 173/80 |
| 4,572,307 | 2/1986 | Tunnell | 175/417 |

*Primary Examiner*—Z. R. Bilinsky

*Attorney, Agent, or Firm*—Burns, Doane, Swecker & Mathis

[57] ABSTRACT

A drill bit for use in a drill string comprising a set of a plurality of central rod members and a set of a plurality of tubular members surrounding said rod members. The drill bit is provided with a longitudinally extending flushing channel which communicates with an annular space between the rod members and the tubular members via a transverse passage. The flushing channel comprises at least two end passages terminating in the bit front. The cross section area of each of the end passages is smaller than the overall cross section area of the portion of the flushing channel located between the end passages and the transverse passage.

4 Claims, 4 Drawing Sheets

DRILL BIT

This application is a continuation, divisional, of application Ser. No. 06/847,708, filed Apr. 3, 1986, now abandoned.

BACKGROUND OF THE INVENTION

This invention relates to a drill bit for use in a drill string comprising a plurality of central rod members for transmitting impacts to the drill bit and a plurality of tubular members for transmitting rotation to the drill bit, said tubular members surrounding said rod members, wherein the drill bit is provided with a flushing channel which extends rearwards from the bit front and terminates in an intermediate portion of the drill bit, and a transverse passage at the intermediate portion, said transverse passage interconnecting said flushing channel and an annular space formed between the rod members and the tubular members.

In a drill string of the above-described type the central rod members are adapted to transmit impact energy and feeding force to the drill bit, and the tubular members are adapted to transmit torque and withdrawal force to the drill bit, whereby an extension rock drill equipment is obtained in which the energy losses are small. A drill string of this type is described in U.S. Pat. No. 4,094,364 which is incorporated in the present description by way of reference.

In the device described in U.S. Pat. No. 4,094,364 the drill bit comprises a main body provided with cutting means which is threadedly connected to the elongated shank portion of the drill bit, said shank portion being inserted in the forward end of the tubular members. In this two-piece design of the drill bit, the bit is guided comparatively far away from the bit front, which means that the hole might have a tendency to deviate from the desired drilling direction. Further, the threaded connection between the main body and the shank portion means that the use of threads is not completely eliminated; ie threads causing energy losses and threads that might be broken.

The object of the invention is therefore to provide a drill bit of the type in question in which no energy losses do arise in the drill bit itself, and which is guided as close as possible to the bit front.

For strength reasons it has been found necessary that a drill bit of the type in question is closed at its rear impact-receiving end surface. Further, flushing fluid must be conducted to at least two spaced positions on the bit front in order to render the flushing efficient. Therefore, another object of the invention is to provide a drill bit in which the flushing channel is produced and designed in such a way that the above-mentioned two requirements are met.

THE DRAWINGS

The invention is described in detail in the following with reference to the accompanying drawings in which various embodiments are shown by way of example. These embodiments are only illustrative of the invention and can be modified within the scope of the claims.

In the drawings.

In the drawings, corresponding details have been given the same reference numeral.

DETAILED DESCRIPTION OF PREFERRED EMBODIMENTS OF THE INVENTION

Figure 1:
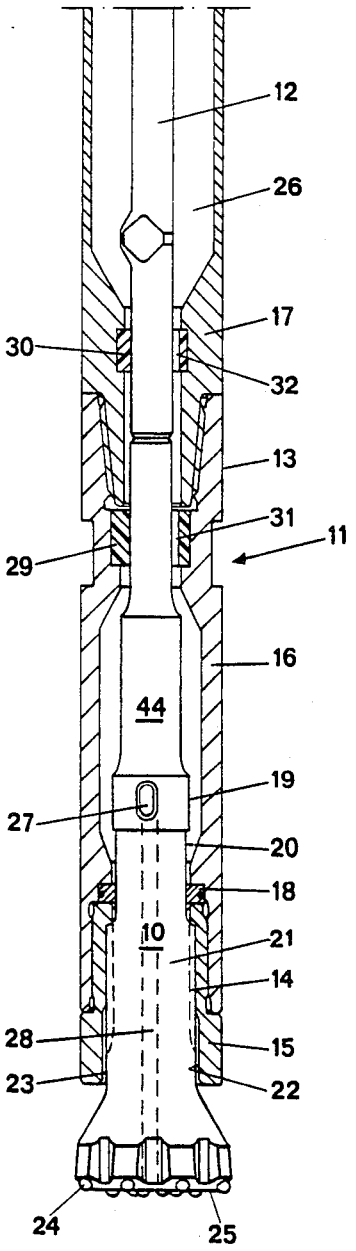
FIG. 1 shows a side view of a drill bit according to the present invention and a sectional side view of the front portion of the associated drill string.

In FIG. 1 a drill bit 10 is shown which is mounted in the foward end of a drill string generally denoted by 11. The drill string 11 comprises a set of a plurality of central rod members 12 which transmit impacts to the drill bit 10. In FIG. 1, only the rod member 12 nearest to the drill bit 10 is shown. The drill string 11 further comprises a set of a plurality of tubular members 13 which transmit rotation to the drill bit 10, said tubular members surrounding said rod members. In order to transmit this rotation the drill bit 10 and the front end of the tubular members 13 are provided with cooperation splines 14. The splines of the tubular members 13, then, are provided in a bit sleeve 15, which is threaded to a bit tube 16. The bit sleeve 15 and the bit tube 16, thus, form the forward end of the set of tubular members 13 and are threaded to the first one of a plurality of similar drill tubes 17 in the set of tubular members 13.

The drill bit 10 is prevented from falling out of the drill string 11 during withdrawal thereof by means of a stop ring 18 which cooperates with a thickened portion 19 on the drill bit 10. The stop ring 18 is forced against an abutment in the bit tube 16 by means of the bit sleeve 15. Thus, the drill bit 10 is provided with a portion 20 having reduced diameter between the thickened portion 19 and the portion 21 having splines. In the illustrated embodiment the portion 20 extends between the portions 19, 21.

At its forward end the bit sleeve 15 is provided with a cylindrical guiding surface 22 which cooperates with a corresponding cylindrical guiding surface 23 on the drill bit 10. Due to the fact that the guiding surfaces 22, 23 are located immediately behind the front 25 on the drill bit 10 it is ensured that an efficient guiding of the drill bit is obtained, thereby decreasing the risk that the hole will deviate from the desired direction. The bit front 25 is provided with cutting means in the form of hard metal inserts 24. Since the drill bit is made in one piece, energy losses otherwise arising in the drill bit are eliminated.

Flushing medium, usually air or water, is supplied to the drill bit 10 through the annular space 26 formed between the set of rod members 12 and the set of tubular members 13. In the thickened portion 19 of the drill but 10 there is provided a transverse passage 27. The transverse passage 27 communicates with a longitudinally extending flushing channel 28 in the drill bit. The flushing medium, thus, is conducted from the space 26 to the bit front 25 through the passages 27, 28.

A bushing 29 is mounted in the bit sleeve 16 for guiding the rear portion of the drill bit 10. In the forward end of the drill tube 17 a bushing 30 is mounted for guiding the forward end of the drill rod 12. At the rear end of the drill tube 17 there is provided a bushing similar to the bushing 29 for guiding the rear end of the drill rod 12. The bushings 29, 30, thus, work as guides or friction bearings for the drill rods 12 and the drill bit 10. The bushings 29, 30, which can be made of for instance bronze, plastics or rubber, are provided with passages 31, 32 traversing therethrough, through which the flushing medium flows. Preferably, a plurality of passages 31, 32 are spaced around the circumference of the bushings 29, 30.

As above-mentioned it has been found necessary to have the impact-receiving rear end surface of the drill bit 10 closed, i.e., the flushing channel 28 must not extend entirely through the drill bit 10. Further, the flushing medium through the flushing channel must be conducted to at least two positions on the bit front 25 in order to make the flushing efficient. At the same time it must be ensured that an amount of flushing medium large enough is conducted through each of the end passages terminating in the bit front. This has been achieved by making the cross section area of each of the end passages smaller than the overall cross section area of the portion of the flushing channel 28 between the end passages and the transverse passage 27.

Figure 2:
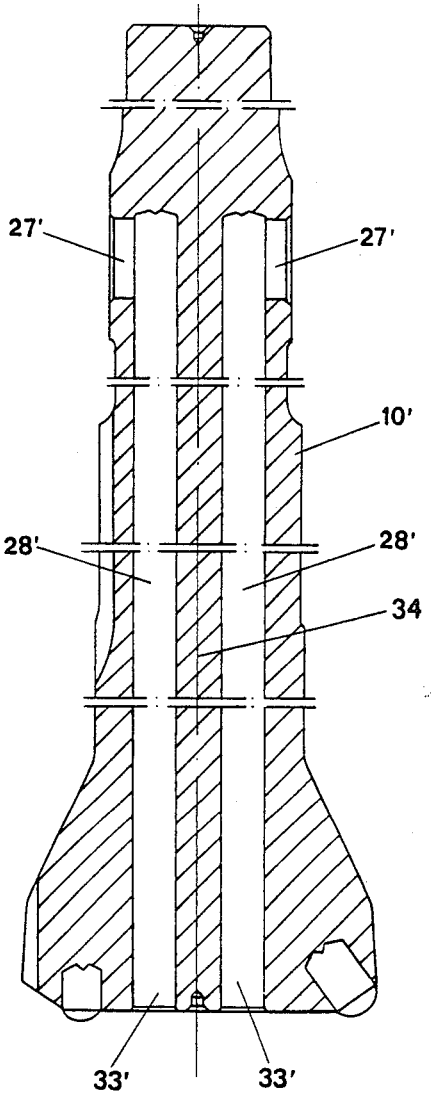
FIG. 2 shows in section one embodiment of a drill bit according to the invention.

In the embodiment shown in FIG. 2 two flushing channels 28' are provided in the drill bit 10', and each of the end passages 33' forms an extension of a flushing channel of its own. The cross section area of one end passage 33', thus, is the same as the cross section area of a flushing channel 28'. The passages 28', 33' extend parallel with the longitudinal axis 34 of the drill bit 10 and are symmetrically arranged relative to the longitudinal axis 34. Alternatively, a plurality of passages 28', 33', preferably mutually parallel, can be provided in the drill bit 10. In the illustrated embodiment the flushing channels 28' communicate each with its own transverse passage 27'. Alternatively, however, the passages 27' can be replaced by one passage traversing through the drill bit.

Figure 3:
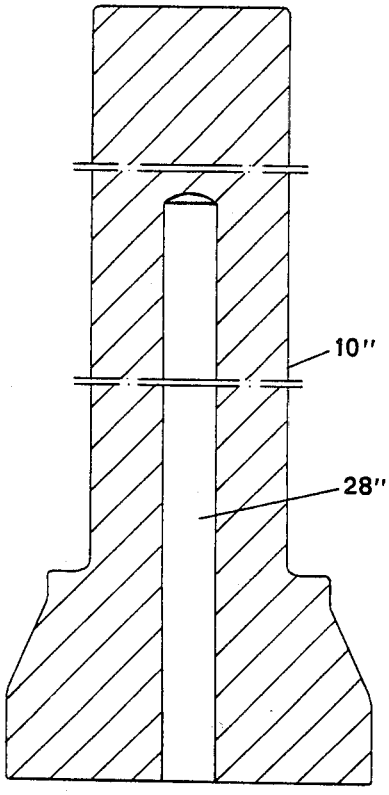
FIGS. 3 and 4 illustrate another embodiment of a drill bit according to the invention.
Figure 4:
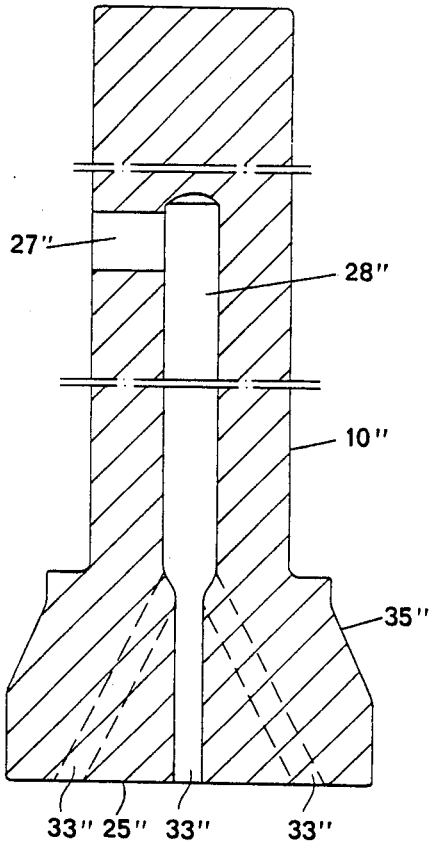

In the embodiments according to FIGS. 3–8 there are diagrammatically shown different embodiments of a drill bit according to the invention in the form of blanks for drill bits. In the embodiment shown in FIGS. 3 and 4 a flushing channel 28'' is drilled in the drill bit 10'' as illustrated in FIG. 3. The cross section area of the forward end of the flushing channel 28'' is then reduced by forging the front portion 35'' of the drill bit so as to provide an end passage 33'' having reduced cross section area. Then, one or several end passages 33'' are drilled between the bit front 25'' and the flushing channel 28''. Specifically, the end passage 33'' in alignment with the flushing channel 28'' can be completely eliminated by the forging operation.

Figure 5:
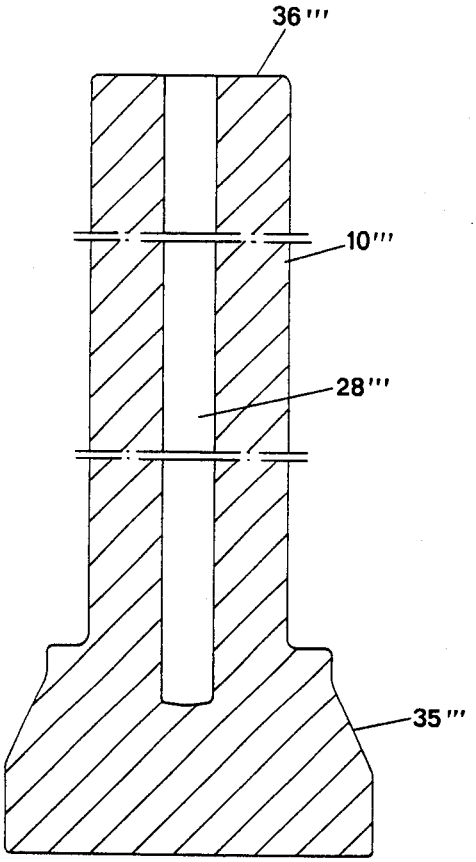
FIGS. 5 and 6 illustrate a further embodiment of a drill bit according to the invention.
Figure 6:
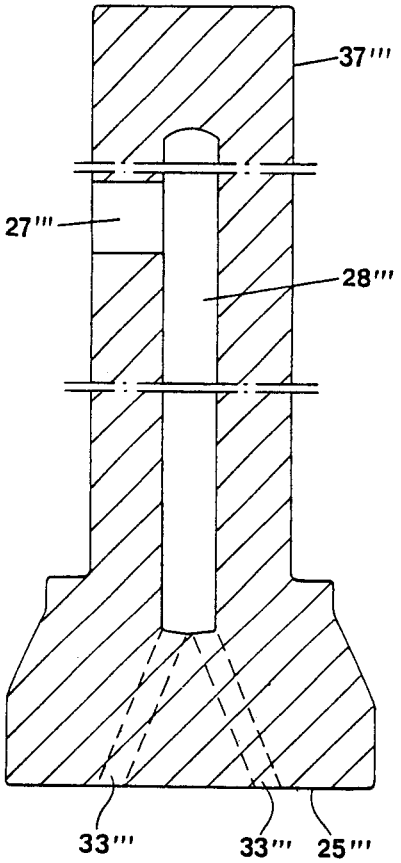

In the embodiment shown in FIGS. 5 and 6 one flushing channel 28''' is drilled from the rear end face 36''' of the drill bit 10''' to the front portion 35''' as illustrated in FIG. 5. Then, the rear portion 37''' of the drill bit is forged so that the bore therein is eliminated, see FIG. 6. Two or several end passages 33''' are then drilled between the bit front 25''' and the flushing channel 28'''.

Figure 8:
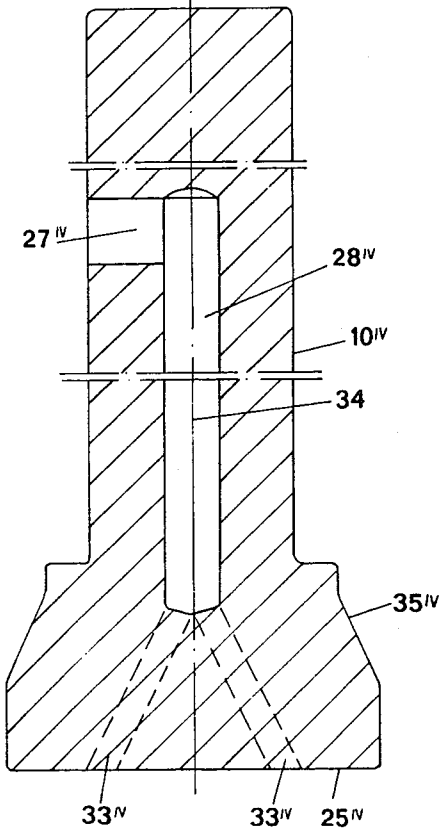
FIGS. 7 and 8 illustrate a still further embodiment of a drill bit according to the invention.
Figure 7:
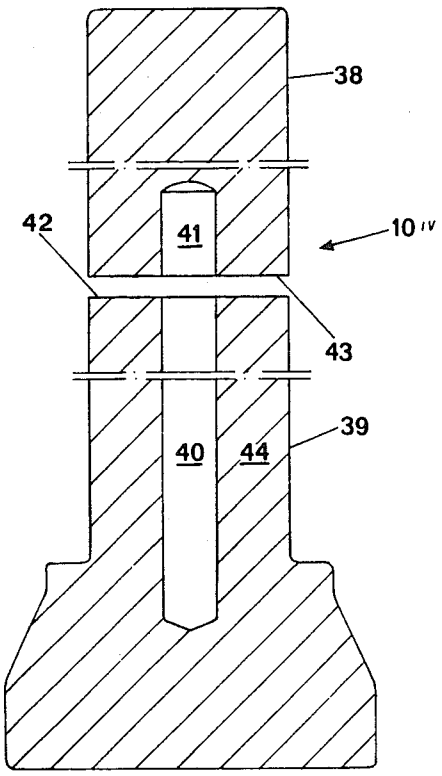

In the embodiment shown in FIGS. 7 and 8 the blank for the drill bit $10^{IV}$ comprises two members 38, 39. Two blind holes 40, 41 are drilled in the members 38, 39 from the faces 42, 43 thereof facing each other. Then, the members 38, 39 are welded along the surfaces 42, 43 by means of butt welding. End passages $33^{IV}$ are drilled between the bit front $25^{IV}$ and the flushing channel $28^{IV}$. It is to be understood that the welding plane can be placed anywhere along the bores 40, 41. Specifically, the bore 41 can be wholly eliminated. In general, however, the portion of the drill bit located behind the transverse passage $27^{IV}$ is welded to the intermediate portion 44 of the drill bit located between the first-mentioned portion and the front portion $35^{IV}$. It is to be understood that the intermediate portion 44 is the portion of the drill bit extending to the stop ring 18.

Figure 9:
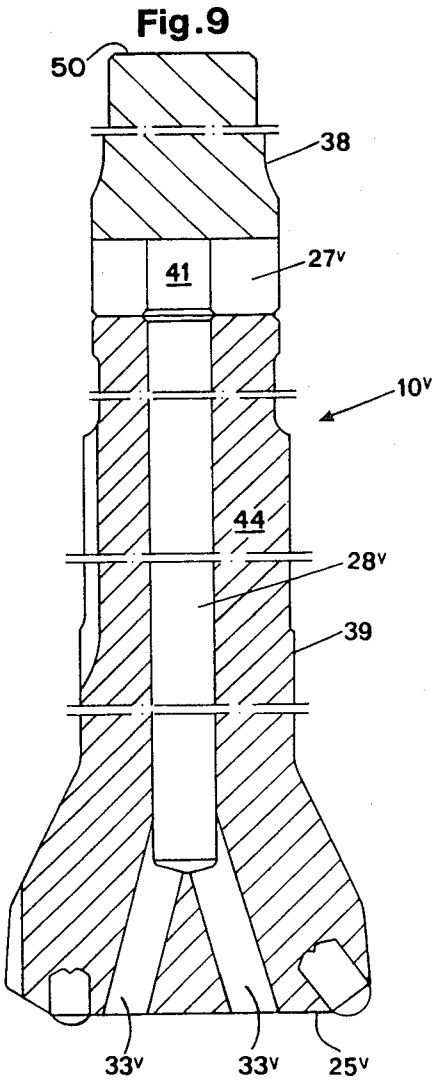
FIG. 9 illustrates still another embodiment of a drill bit according to the invention.

In the embodiment shown in FIG. 9 the blank of the drill bit $10^{v}$ also comprises rear and front members 38, 39 in FIG. 7. However, the members 38, 39 are not welded to each other but are adapted to loosely rest against each other in the final shape of the drill bit. End passages $33^{V}$ are made between the bit front $25^{V}$ and the flushing channel $28^{V}$ formed by the bores 40, 41. The transverse passage $27^{V}$ is arranged in the rear member 38 in immediate connection to the parting plane between the members 38, 39, Generally, however, it is believed to be possible to place this parting plane anywhwere along the intermediate portion 44. For strength reasons, however, it is preferable to have the parting plane extending through the thickened portion 19. No energy losses arise in this two-piece drill bit since there is no threaded connection therein. Impacts from the adjacent rod member are applied against the bit rear end 50 defined by the rear member 38.

We claim:

1. A drill string comprising a drill bit, a plurality of mutually aligned central rod members disposed behind and in alignment with said drill bit, a forwardmost one of said rod members abutting said drill bit for transmitting impacts to the drill bit, and a plurality of tubular members for transmitting rotation to the drill bit, said tubular members surrounding said rod members and spaced radially therefrom to form a space therebetween defining a continuous uninterrupted fluid passage which extends forwardly beyond a rear end of said bit to conduct a forward flow of flushing medium, the drill bit provided with a flushing channel which extends rearwardly from the bit front end and terminates short of a bit rear end in an intermediate portion of the drill bit, and a transverse passage at the intermediate portion, said transverse passage interconnecting said flushing channel with said annular space, said flushing channel comprising at least two end passages terminating in the bit front end, the cross-sectional area of each of the end passages being smaller than the overall cross-sectional area of a portion of the flushing channel extending between the end passages and the transverse passage, said drill bit comprising separate front and rear members, said rear member resting loosely against said front member and including a solid rear face which defines said rear end of said drill bit to be contacted by an adjacent one of said rod members for transferring impact forces to said front end of said drill bit defined by said front member, said front member comprising a one-piece body carrying cutting elements at a forward end thereof and being engaged at a rearwardly facing end thereof by said rear member.

2. A drill bit according to claim 1, wherein a parting line between said front and rear members is disposed at said transverse passage.

3. A drill bit according to claim 2, wherein said transverse passage is formed in said rear member and is closed off along its front side by said front member.

4. A drill bit according to claim 2, wherein said rear member defines a cross-sectionally enlarged portion of said drill bit, said front member carrying external splines which mesh with internal splines of an adjacent one of said tubular members, a portion of said front member disposed between said external splines and said rear member having a smaller cross-section than said enlarged portion.

* * * * *

UNITED STATES PATENT AND TRADEMARK OFFICE

CERTIFICATE OF CORRECTION

PATENT NO. : 4,805,705

DATED : February 21, 1989

INVENTOR(S) : Sven P.Liljebrand; Bernt S. Liljekvist

It is certified that error appears in the above-identified patent and that said Letters Patent is hereby corrected as shown below:

Column 4, line 54, change "drill bit" to -- drill string --.

Column 4, line 57, change "drill bit" to -- drill string --;

Column 4, line 60, change "drill bit" to -- drill string --.

Signed and Sealed this

Twenty-seventh Day of March, 1990

*Attest:*

*Attesting Officer*

JEFFREY M. SAMUELS

*Acting Commissioner of Patents and Trademarks*